US009307306B2

(12) United States Patent
Li et al.

(10) Patent No.: US 9,307,306 B2
(45) Date of Patent: Apr. 5, 2016

(54) MICRO LOUDSPEAKER AND ELECTRONIC DEVICE USING SAME

(71) Applicant: GOERTEK INC., WeiFang (CN)

(72) Inventors: Yunhai Li, WeiFang (CN); Shanglei Ning, WeiFang (CN); Guanglei Liu, WeiFang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 14/389,687

(22) PCT Filed: Sep. 20, 2012

(86) PCT No.: PCT/CN2012/081702

§ 371 (c)(1),
(2) Date: Sep. 30, 2014

(87) PCT Pub. No.: WO2013/143262

PCT Pub. Date: Oct. 3, 2013

(65) Prior Publication Data

US 2015/0063607 A1 Mar. 5, 2015

(30) Foreign Application Priority Data

Mar. 31, 2012 (CN) ..... 201210095025

(51) Int. Cl.

| | |
|---|---|
| ***H04R 25/00*** | (2006.01) |
| ***H04R 1/00*** | (2006.01) |
| ***H04R 1/06*** | (2006.01) |
| *H04R 1/02* | (2006.01) |
| *H04R 9/06* | (2006.01) |

(52) U.S. Cl.

CPC .. *H04R 1/00* (2013.01); *H04R 1/06* (2013.01); *H04R 9/06* (2013.01); *H04R 2499/11* (2013.01)

(58) Field of Classification Search

CPC ..... H04R 1/025; H04R 1/12; H04R 1/22; H04R 1/345; H04R 1/2819; H04R 1/2826; H04R 7/16; H04R 11/00; H04R 11/02; H04R 17/00; H04R 17/02; H04R 1/2482; H04R 9/02; H04R 9/025; H04R 9/06; H04R 9/063; H04R 23/006; H04R 31/006; H04R 2400/03

USPC ..... 381/150, 162, 345, 396

See application file for complete search history.

(56) References Cited

U.S. PATENT DOCUMENTS

| | | | | |
|---|---|---|---|---|
| 2002/0071589 | A1* | 6/2002 | Klein et al. | 381/396 |
| 2005/0265574 | A1* | 12/2005 | Holmes et al. | 381/388 |
| 2006/0018500 | A1* | 1/2006 | Watanabe | 381/396 |

FOREIGN PATENT DOCUMENTS

| | | | |
|---|---|---|---|
| CN | 201995124 | U | 9/2011 |
| CN | 102625216 | A | 1/2012 |

(Continued)

OTHER PUBLICATIONS

International Search Report for PCT/CN2012/081702 filed on Sep. 20, 2012.

*Primary Examiner* — Brian Ensey

(57) ABSTRACT

Disclosed is a micro loudspeaker. The casing of the micro loudspeaker comprises an upper side surface and a lower side surface. An electric connecting piece comprises a first deformation part located on one side of the upper side surface of the casing and side bent upwards, a second deformation part located on one side of the lower side surface and side bent downwards, a connecting part electrically connecting the first deformation part and the second deformation part. The top end of the first deformation part and the bottom end of the second deformation part are respectively provided with a first conducting part and a second conducting part. An electronic device comprises a micro loudspeaker mentioned above, a shell, a first sound hole and a circuit board, wherein a first conducting part or a second conducting part of the micro loudspeaker is electrically connected to the circuit board.

10 Claims, 5 Drawing Sheets

(56) References Cited

FOREIGN PATENT DOCUMENTS

| | | | |
|---|---|---|---|
| CN | 202111854 U | 11/2012 | |
| JP | 2001-127862 A | 5/2001 | |
| JP | 2009-164866 A | 7/2009 | |

* cited by examiner

MICRO LOUDSPEAKER AND ELECTRONIC DEVICE USING SAME

TECHNICAL FIELD

The present invention relates to the field of electricity, more specifically, to a micro loudspeaker and an electronic device using same.

BACKGROUND

A micro loudspeaker comprises a vibration system, a casing for accommodating and fixing the vibration system, and an electric connecting piece for electrically connecting an internal circuit and an external circuit. The vibrating system comprises a vibrating diaphragm and a voice coil provided at the bottom side of the vibrating diaphragm, the casing comprises an upper side surface for bonding to the vibrating diaphragm and a lower side surface opposite to the upper side surface. The electric connecting piece comprises a conducting part for electrically connecting with the external circuits.

In the prior art, the conducting part is typically arranged in the lower side surface of the casing. However, the micro loudspeaker having such a structure has single way of assembling with electronic devices of terminal, and the position where the micro loudspeaker mounted in the electronic device cannot be adjusted flexibly, which does not facilitate the improvement of the assembly suitability of the micro loudspeaker and an electronic device.

Moreover, for an electronic device which is required to mount micro loudspeaker, such as a mobile phone, the position where the micro loudspeaker mounted depends on the internal space of the electronic device. Thus, the micro loudspeaker which has single way of assembling does not facilitate the deploy of the internal components in the internal space of the electronic device, and make it hard for the electronic device to meet required properties, such as thickness, size and so on of the product.

Thus, there is a demand for improving the micro loudspeaker having the above structure and the electronic device using same to avoid the above defects.

SUMMARY

For the sake of the above problems, an objective of the present invention is to provide a micro loudspeaker and an electronic device using same to enable the diversity of methods for assembling the micro loudspeaker and the electronic device, and increase the assembly suitability of the micro loudspeaker and an electronic device, and facilitate to realize the design requirements of the electronic device.

In order to achieve the above objective, the present invention provides a micro loudspeaker, comprising a vibrating system, a casing for accommodating and fixing the vibrating system and a electric connecting piece; the vibrating system comprises a vibrating diaphragm and a voice coil provided at the lower side of the vibrating diaphragm, the casing comprises an upper side surface for fixedly bonding to the vibrating diaphragm and a lower side surface opposite to the upper side surface, the electric connecting piece is fixedly bonded to the casing.

The electric connecting piece is of an elastic sheet structure, and comprises a first deformation part, a second deformation part and a connecting part; wherein, the first deformation part is located on one side of the upper side surface of the casing, the second deformation part is located on one side of the lower side surface of the casing, the connecting part electrically connects the first deformation part with the second deformation part; the first deformation part is of a structure which is bent upwards, the second deformation part is of a structure which is bent downwards; and the top end of the first deformation part and the bottom end of the second deformation part are respectively provided with a first conducting part and a second conducting part for electrically connecting with external circuits.

Furthermore, it is a preferred embodiment that the electric connecting piece comprises an internal pad for electrically connecting with the lead wire of the voice coil, and the internal pad is electrically connected with both the first deformation part and the second deformation part.

Furthermore, it is a preferred embodiment that the micro loudspeaker further comprises a front cover provided at the upper side of the vibrating diaphragm, the first conducting part is higher than the plane where the top of the front cover is positioned, and the second conducting part is lower than the plane where the bottom of the casing is positioned.

Furthermore, it is a preferred embodiment that the casing has a shape of rectangle, and both sides of the minor axis of the casing are provided with mounting parts for mounting the electric connecting pieces.

Furthermore, it is a preferred embodiment that the electric connecting piece comprises two pieces symmetrically bonded to two sides of the minor axis of the casing, respectively.

Furthermore, it is a preferred embodiment that the electric connecting piece is bonded to the casing by injection molding.

The present invention provide an electronic device, wherein the electronic device comprises the micro loudspeaker; the electronic device further comprises a shell, a first sound hole arranged on the shell, and a circuit board located inside of the shell and directly facing the first sound hole; the first conducting part or the second conducting part of the micro loudspeaker is electrically connected with the circuit board.

Furthermore, it is a preferred embodiment that the micro loudspeaker is bonded to one side of the circuit board away from the first sound hole, and the first conducting part is electrically connected with the circuit board, and a sound hole formed at the position on the circuit board directly facing the first sound hole by removing material thereof, and the vibrating diaphragm is arranged to be directly facing the second sound hole.

Furthermore, it is a preferred embodiment that the micro loudspeaker is bonded to one side of the circuit board proximate to the first sound hole, and the second conducting part is electrically connected with the circuit board, and the vibrating diaphragm is arranged to be directly facing the first sound hole.

Adopted with the above technical scheme, compared with traditional structure of a micro loudspeaker, the upper side surface and the lower side surface of the casing of the present invention are provided with the first conducting part and the second conducting part respectively, enabling diversity of methods for assembling the micro loudspeaker and the electronic device, increasing the assembly suitability of the micro loudspeaker and an electronic device, and facilitating to realize the design requirements of the electronic device.

In order to achieve the above and related objectives, one or more aspects of the present invention comprise the features are detailed below and particularly indicated in the claims. Some exemplary aspects of the present invention are described in details by the description below and the accompanying drawings. However, these aspects only indicate some implementations of various implementations of the present invention. In addition, the present invention is intended to contain these aspects and the equivalents thereof.

BRIEF DESCRIPTION OF THE DRAWINGS

By referring to the content of description of the accompanying drawings and the claims below, and with a full understanding of the present invention, other purposes and results of the present invention will be understand more clearly and easily. In the drawings:

Figure 1:
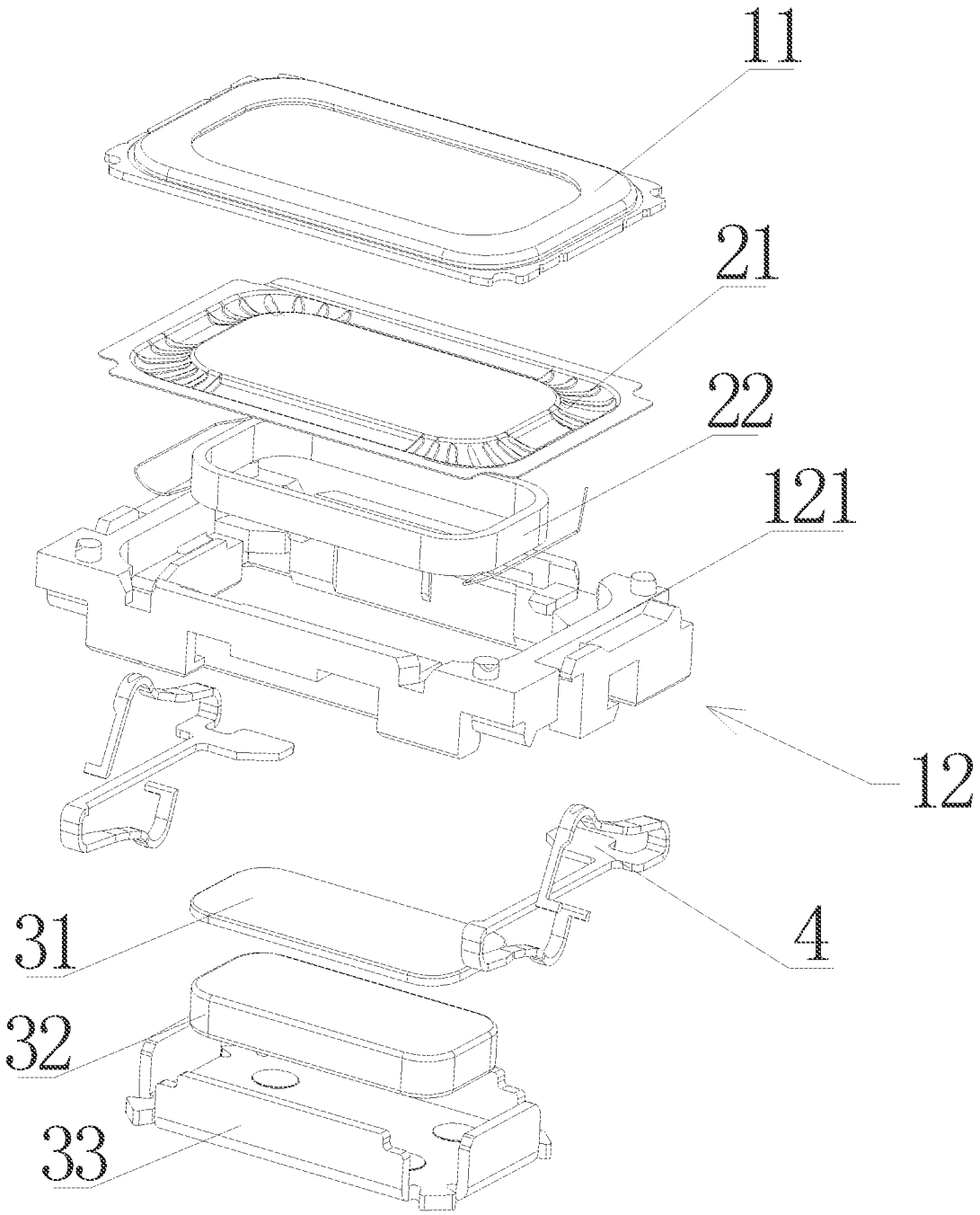
FIG. 1 is a schematic view illustrating the 3D exploded structure of the micro loudspeaker of the present invention.

Similar signs in all figures indicate similar or corresponding features or functions.

DETAILED DESCRIPTION

Various specific details are set forth in the following description to comprehensively understand one or more embodiments for the sake of illustration. However, it is obvious that these embodiments can be implemented without such specific details. In other examples, prior structures and devices are showed by block diagrams to facilitate describing one or more embodiments.

The present invention is described in details in combination with the accompanying drawings and specific embodiments.

FIGS. 1 to 5 illustrate the 3D exploded view and the assembly structure schematic view of the micro loudspeaker according to the embodiment of the present invention, respectively. As illustrated in FIGS. 1 to 5, the micro loudspeaker comprises a vibrating system, a magnetic circuit system and a casing 12 for accommodating and fixing the vibrating system and the magnetic circuit system. The vibrating system comprises a vibrating diaphragm 21 and a voice coil 22 provided at the lower side of the vibrating diaphragm 21, the casing 12 comprises an upper side surface fixedly bonding to the vibrating diaphragm 21 and a lower side surface opposite to the upper side surface. The magnetic circuit system comprises a washer 31, a magnet 32 and a frame 33 disposed in sequence, and the magnetic circuit system is accommodated and fixed by the casing 12, and forms a magnetic gap for accommodating the voice coil 22. The front cover 11 is provided at the upper side of the vibrating diaphragm 21, and forms a peripheral frame of the micro loudspeaker with the casing 12.

Figure 2:
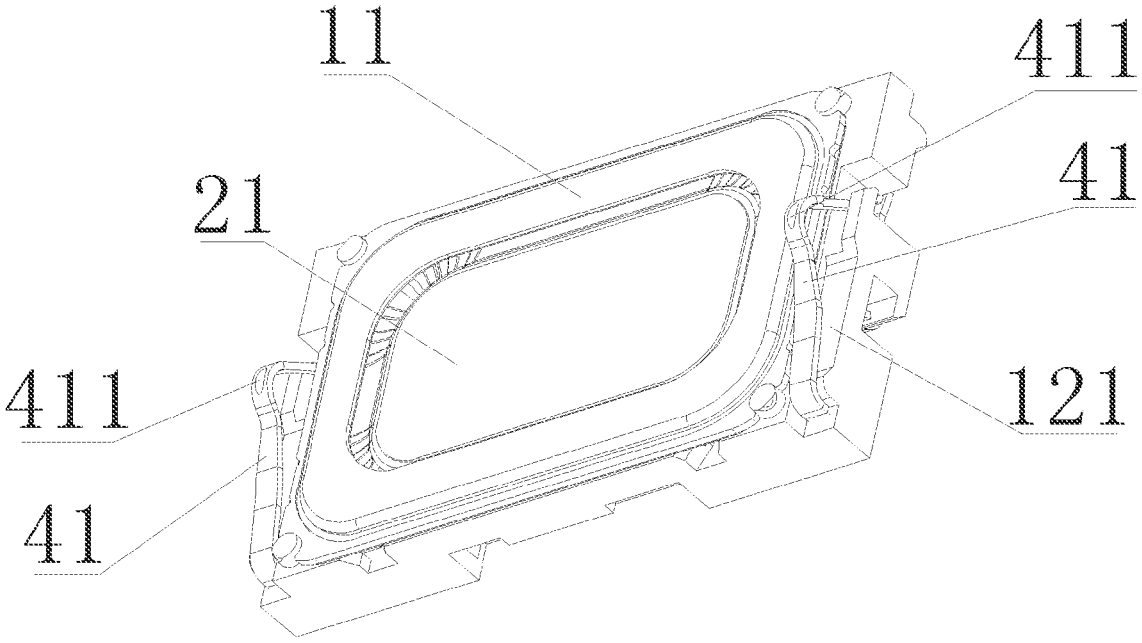
FIG. 2 is a schematic view illustrating the 3D structure of the micro loudspeaker of the present invention.
Figure 3:
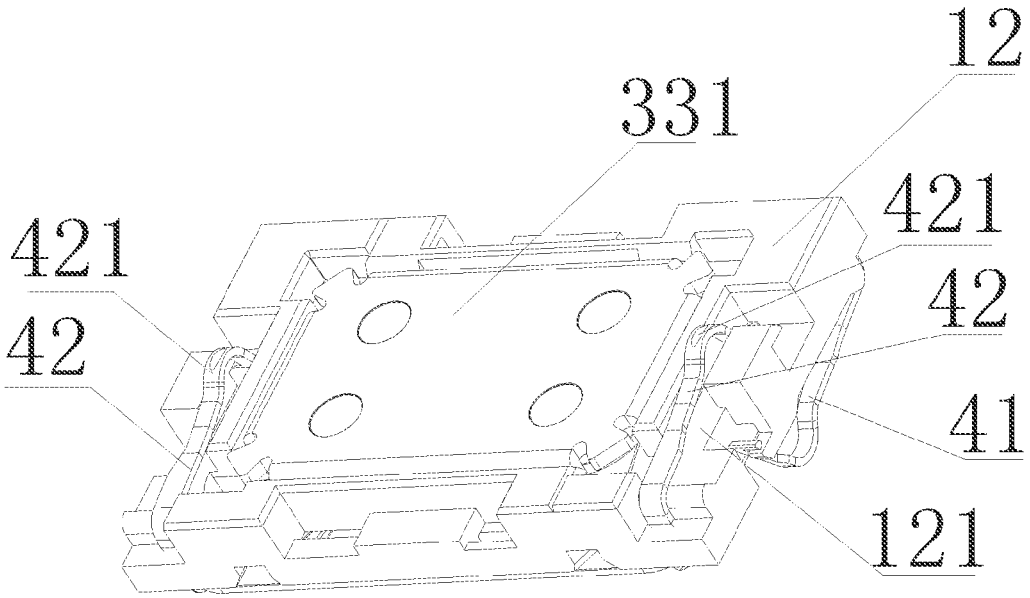
FIG. 3 is a schematic view illustrating the 3D structure of the micro loudspeaker of the present invention.

Moreover, the micro loudspeaker further comprises an electric connecting piece 4 for electrically connecting the internal circuit with the external circuit of the micro loudspeaker and the electric connecting piece is fixedly bonded to the casing. In a preferred embodiment of the present invention, the electric connecting piece 4 is bonded to the casing 12 by injection molding. In the present embodiment, the electric connecting piece 4 is of an elastic sheet structure comprising two parts independent and symmetric to each other, each of which comprises a first deformation part 41 which is located in the upper side surface of the casing 12 and a second deformation part 42 which is located in the lower side surface of the casing 12, and both the first deformation part 41 and the second deformation part 42 can be used for electrically connecting with external circuits, as illustrated in FIGS. 2 to 5. After the electric connecting piece 4 is fixedly bonded to the casing 12, the first deformation part 41 thereof and the vibrating diaphragm 21 are located at the same side of the casing 12, and the second deformation part 42 and the bottom wall 331 of the frame 33 are located at the same side, as illustrated in FIGS. 2 and 3.

Figure 4:
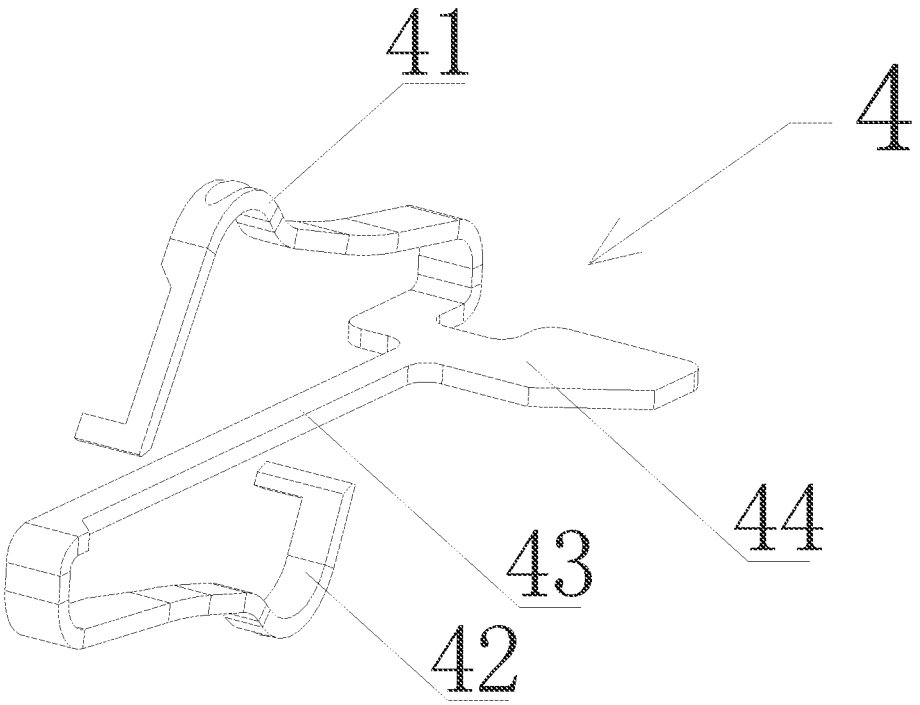
FIG. 4 is a schematic view illustrating the 3D structure of the electric connecting piece of the present invention.

FIG. 4 is a schematic view illustrating the 3D structure of the electric connecting piece of the present invention. As illustrated in FIG. 4, the first deformation part 41 and the second deformation part 42 is electrically connected with the connecting part 43, and the internal pad 44 is used for electrically connecting with the lead wire of the voice coil 22. In the electric connecting piece 4 configured according to the present invention, the internal pad 44 electrically connects with both the first deformation part 41 and the second deformation part 42, that is, the electric signal in the voice coil 22 can be controlled by the electric signal in the first deformation part 41 or the second deformation part 42 separately.

Figure 5:
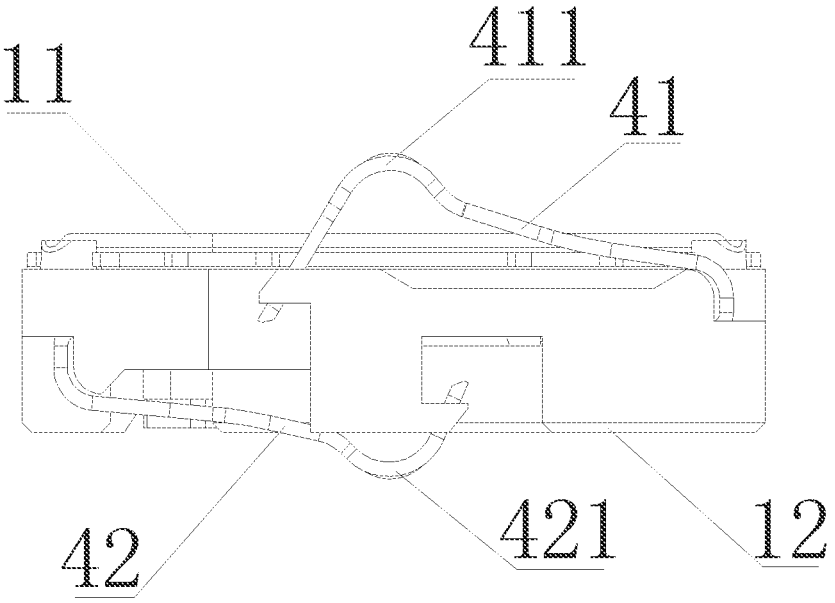
FIG. 5 is a schematic view illustrating the side surface structure of the micro loudspeaker of the present invention.

Furthermore, the first deformation part 41 is bent upwards, and the second deformation part 42 is bent downwards. A first conducting part 411 for electrically connecting with external circuits is provided on the top of the first deformation part 41 (as illustrated in FIG. 2). A second conducting part 421 for electrically connecting with external circuits is provided on the bottom of the second deformation part 42 (as illustrated in FIG. 3). Both the first deformation part 411 and the second deformation part 421 can be used for electrically connecting with external circuits directly. Wherein, after all the components of the micro loudspeaker are assembled, the first conducting part 411 is higher than the plane where the top of the front cover 11 is positioned, while the second conducting part 421 is lower than the plane where the bottom of the casing 12 is positioned, as illustrated in FIG. 2, FIG. 3 and FIG. 5. Having such a structure, it is conducive to electrically connecting the first conducting part 411 and the second conducting part 421 with external circuits directly.

In the present embodiment, the casing 12 has a shape of rectangle, as showed in FIG. 1 and FIG. 2. The electric connecting piece 4 is fixedly bonded to the minor axis of the casing 12, a mounting part 121 is arranged at the position in the upper side surface of the casing 12 proximate to the edge of the vibrating diaphragm 21, and the electric connecting piece 4 is fixedly mounted on the mounting part 121.

Moreover, with respect to the structure of the micro loudspeaker of the present invention, other improvements can be made. For example, the electric connecting piece 4 is not limited to mounting on the minor axis of the casing 12, but can be mounted on the long axis thereof, or the casing 12 can also be of a circular shape, track-shaped or oval shape, each of which does not affect the implementation of the present invention and can achieve the above objectives.

Figure 6:
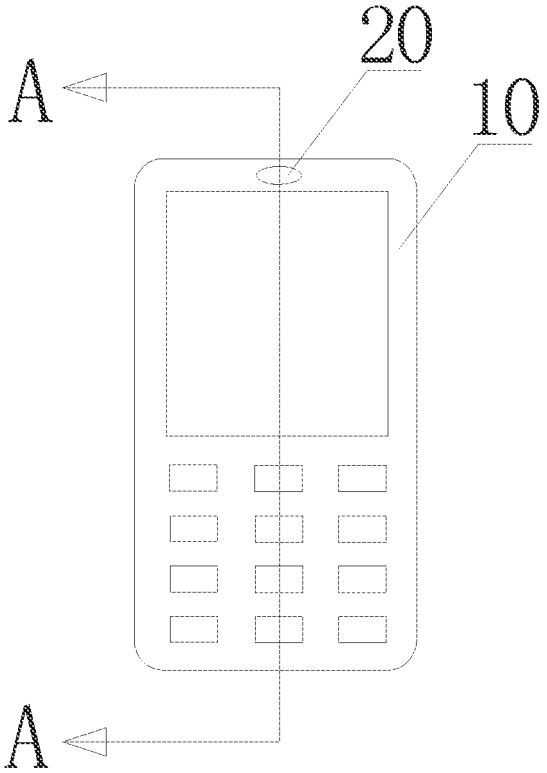
FIG. 6 is a schematic view illustrating the structure of the electronic device of the present invention.
Figure 7:
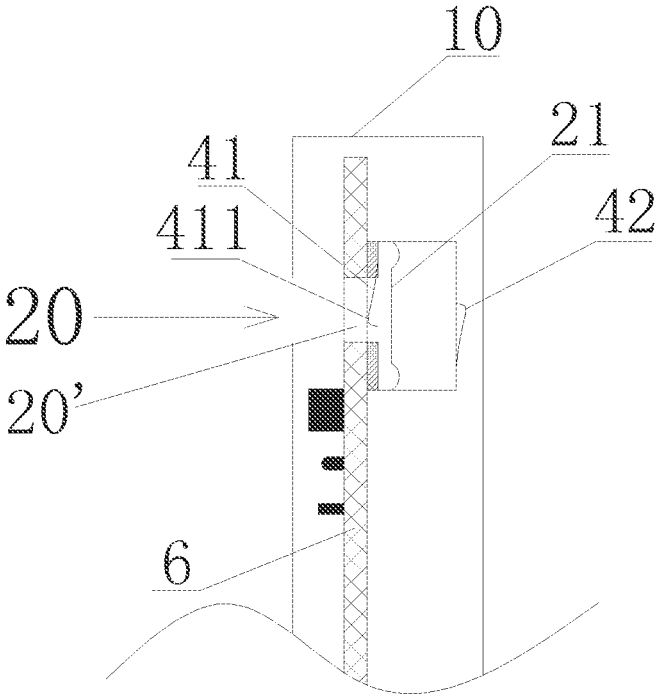
FIG. 7 is a schematic view illustrating the sectional structure taken along A-A of the electronic device in FIG. 6.

FIG. 6 is a schematic view illustrating the structure of the electronic device using the above micro loudspeaker of the present invention, FIG. 7 is a schematic view illustrating the sectional structure of the taken along A-A of the electronic device in FIG. 6 (i.e., a schematic view illustrating the structure of the micro loudspeaker after being assembled with the electronic device). As illustrated in FIGS. 6 and 7, the electronic device comprises a shell 10 on which a first sound hole 20 is provided, and the first sound hole 20 is required to be communicated with the vibrating diaphragm 21 so that the sound of the micro loudspeaker can be transmitted outside through the first sound hole 20.

A circuit board 6 is provided inside the electronic device, and the circuit board 6 is arranged to be directly facing the first sound hole 20, as illustrated in the figures. In the present embodiment, the micro loudspeaker is arranged at one side of the circuit board 6 directed away from the first sound hole 20, and the first conducting part 411 is electrically connected with the circuit board 6, the vibrating diaphragm 21 is arranged at the position directly facing the first sound hole 20. Moreover, a second sound hole 20' formed at the position on the circuit board 6 directly facing the first sound hole 20 by removing material thereof, so that the front side of the vibrating diaphragm 21 is communicated with the first sound hole 20, enabling sound to transmit to outside through the first sound hole 20. The first conducting part 411 on the top of the first deformation part 41 is communicated with the un-removed region at two sides of the second sound hole 20' of the circuit board 6, thus the electric signal in the voice coil 22 can be controlled by the first conducting part 411.

Figure 8:
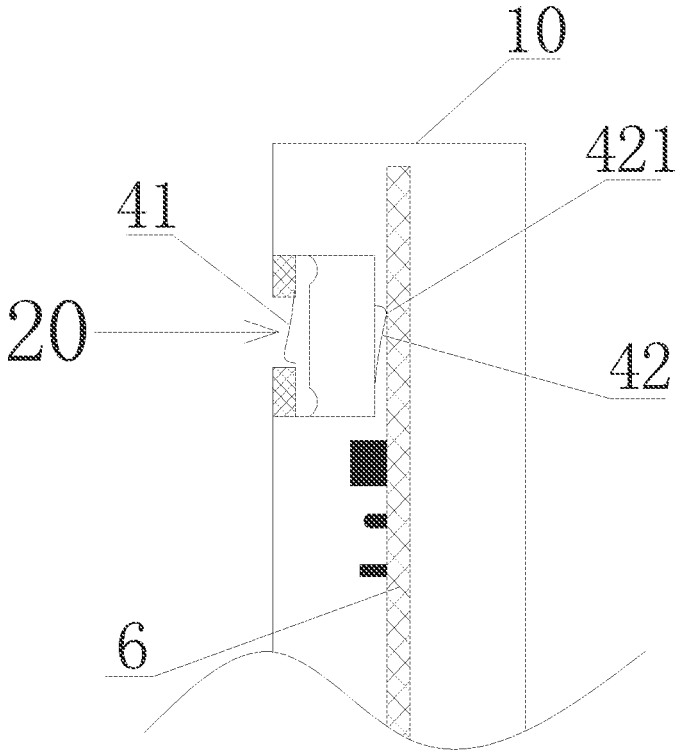
FIG. 8 is a schematic view illustrating the structure of the micro loudspeaker after being assembled with the electronic device in accordance with another embodiment of the present invention.

FIG. 8 is a schematic view illustrating the structure of the micro loudspeaker after being assembled with the electronic device in accordance with another embodiment of the present invention. As illustrated in FIG. 8, the micro loudspeaker of the present embodiment is arranged at one side of the circuit board 6 proximate to the first sound hole 20. The vibrating diaphragm 21 of the micro loudspeaker is arranged to be directly facing the first sound hole 20, and the second conducting part 421 on bottom of the second deformation part 42 is electrically connected with the circuit board 6. Thus the electric signal in the voice coil 22 can be controlled by the second conducting part 421 to make the micro loudspeaker work.

With the design that both sides of the micro loudspeaker are provided with the first conducting part 411 and the second conducting part 421, respectively, the micro loudspeaker can be flexibly arranged at a location in the electronic device, so that the same type of micro loudspeaker can be assembled in different ways, and applied in different products, thereby increasing the assembly suitability of the micro loudspeaker and an electronic device. Adopted with the electronic device of the micro loudspeaker provided by the present invention, there are more deployment options during deploying the positions of the internal components of the electronic device, thereby facilitate to meet the requirements of thickness and size of the electronic device in special designs.

As described above, the micro loudspeaker and electronic device using same of the present invention are described by way of example with reference to the accompanying drawings.

However, it will be understood by those skilled in the art that the specific description on the above mentioned micro loudspeaker and electronic device using same of present invention aims at better understanding of the present invention. With the above teaching of the present invention, other improvements and modifications can be made by those skilled in the art based on the above embodiments, which fall into the scope of the present invention. Accordingly, the scope of protection of the present invention is determined by the contents of the appended claims and the equivalents thereof.

What is claimed is:

1. A micro loudspeaker, comprising a vibrating system, a casing for accommodating and fixing the vibrating system, and an electric connecting piece, wherein the vibrating system comprises a vibrating diaphragm and a voice coil disposed at a lower side of the vibrating diaphragm, the casing comprises an upper side surface that is fixedly bonded to the vibrating diaphragm and a lower side surface opposite to the upper surface, and the electric connecting piece is fixedly bonded to the casing, the micro loudspeaker being characterized in that:

the electric connecting piece has an elastic sheet structure, and comprises a first deformation part, a second deformation part, and a connecting part, wherein:

the first deformation part is located at one side of the upper side surface of the casing, the second deformation part is located at one side of the lower side surface of the casing, the connecting part electrically connects the first deformation part with the second deformation part;

the first deformation part is bent in a first direction;

the second deformation part is bent in a second direction opposite to the first direction; and a top end portion of the first deformation part and a bottom end portion of the second deformation part are respectively a first conducting part and a second conducting part, the first and second conducting parts being electrically connected to external circuits, wherein the electric connecting piece further comprises an internal pad that is electrically connected to a lead wire of the voice coil, and the internal pad is electrically connected to both the first deformation part and the second deformation part, and wherein the micro loudspeaker further comprises a front cover disposed at an upper side of the vibrating diaphragm, the first conducting part is positioned at a level higher than that of a first plane where a top portion of the front cover is positioned, and the second conducting part is positioned at a level lower than that of a second plane where a bottom portion of the casing is positioned.

2. The micro loudspeaker of claim 1, characterized in that:

the casing has a rectangular shape, and two sides of the casing that are parallel to a minor axis of the casing are provided with mounting parts mounting the electric connecting piece.

3. The micro loudspeaker of claim 2, characterized in that:

the electric connecting piece comprises two pieces symmetrically bonded to the two sides of the casing that are parallel to the minor axis of the casing, respectively.

4. The micro loudspeaker of claim 2, characterized in that:

the electric connecting piece is bonded to the casing by injection molding.

5. An electronic device, characterized in that:

the electronic device comprises the micro loudspeaker of claim 1; and the electronic device further comprises a shell, a first sound hole disposed on the shell, and a circuit board located inside of the shell and directly facing the first sound hole, wherein the first conducting part or the second conducting part of the micro loudspeaker is electrically connected with the circuit board.

6. The electronic device of claim 5, further comprising a second sound hole and characterized in that:

the micro loudspeaker is provided at one side of the circuit board away from the first sound hole, and the first conducting part is electrically connected with the circuit board; and the second sound hole is formed at a position on the circuit board directly facing the first sound hole by removing a material of the circuit board, and the vibrating diaphragm is disposed to directly face the second sound hole.

7. The electronic device of claim 5, characterized in that:

the micro loudspeaker is provided at one side of the circuit board proximate to the first sound hole, and the second conducting part is electrically connected with the circuit board, and the vibrating diaphragm is disposed to directly face the first sound hole.

8. An electronic device, characterized in that:

the electronic device comprises the micro loudspeaker of claim 2; and the electronic device further comprises a shell, a first sound hole disposed on the shell, and a circuit board located inside of the shell and directly facing the first sound hole, wherein the first conducting part or the second conducting part of the micro loudspeaker is electrically connected with the circuit board.

9. An electronic device, characterized in that:

the electronic device comprises the micro loudspeaker of claim 3; and the electronic device further comprises a shell, a first sound hole disposed on the shell, and a circuit board located inside of the shell and directly facing the first sound hole, wherein the first conducting part or the second conducting part of the micro loudspeaker is electrically connected with the circuit board.

10. An electronic device, characterized in that:

the electronic device comprises the micro loudspeaker of claim 4; and the electronic device further comprises a shell, a first sound hole disposed on the shell, and a circuit board located inside of the shell and directly facing the first sound hole, wherein the first conducting part or the second conducting part of the micro loudspeaker is electrically connected with the circuit board.

* * * * *